US005895215A

United States Patent [19]

Rinker et al.

[11] Patent Number: 5,895,215

[45] Date of Patent: Apr. 20, 1999

[54] CHARGING APPARATUS FOR A ROTARY HEARTH FURNANCE

[75] Inventors: Franklin G. Rinker; Daniel A. Molnar, both of Perrysburg, Ohio; James Howe, Temperance, Mich.; Carl L. Porter, Prospect, Ky.

[73] Assignee: Maumee Research & Engineering, Inc., Maumee, Ohio

[21] Appl. No.: 08/949,572

[22] Filed: Oct. 14, 1997

[51] Int. Cl.[6] ..... F27B 9/16; F27D 3/00

[52] U.S. Cl. ..... 432/138; 414/160; 414/587; 432/239

[58] Field of Search ..... 432/138, 141, 432/143, 144, 239; 414/160, 162, 586, 587, 588

[56] References Cited

U.S. PATENT DOCUMENTS

| | | | |
|---|---|---|---|
| 3,507,408 | 4/1970 | Bramwell | 414/586 |
| 4,049,141 | 9/1977 | Rohde et al. | 414/586 |
| 4,288,194 | 9/1981 | Nemoto et al. | 414/586 |
| 4,622,905 | 11/1986 | MacDougall et al. | 110/347 |
| 5,026,240 | 6/1991 | Kozierok et al. | 432/143 |
| 5,755,837 | 5/1998 | Beierle et al. | 414/160 |

*Primary Examiner*—Teresa Walberg
*Assistant Examiner*—Gregory A. Wilson
*Attorney, Agent, or Firm*—MacMillan, Sobanski & Todd, LLC

[57] ABSTRACT

An apparatus for charging a feed material onto a rotating hearth of a rotary hearth furnace, the rotary hearth furnace including refractory lined inner and outer walls and having a refractory roof supported thereon, the apparatus comprising a table mounted above the rotating hearth and capable of receiving feed material from outside of the rotary hearth furnace, the table extends transversely across the rotating hearth and having a first end including a distribution member, a second end including a plurality of discharge slots, and an intermediate leveling plow; wherein feed material free falls over said distribution member and is distributed across the width of the table and then adjusted to a uniform depth such that as the rotating hearth passes under the stationary table a curtain of feed material is loaded onto the hearth.

27 Claims, 3 Drawing Sheets

CHARGING APPARATUS FOR A ROTARY HEARTH FURNANCE

FIELD OF THE INVENTION

This invention relates to a charging apparatus for a rotary hearth furnace. More particularly, the present invention relates to an apparatus for charging a feed material to a rotating hearth of a rotary hearth furnace.

BACKGROUND OF THE INVENTION

Briefly, a rotary hearth furnace (RFH) is a continuous heating furnace generally having a refractory roof supported by an annular inner refractory lined wall that is circumscribed by a spaced annular outer refractory lined wall. The inner wall and the outer wall cooperatively define a circular hearth path along which a rotating hearth travels on wheels. The rotating hearth generally consists of a metal support plate including a top of refractory material and having skirts on either side which project into water-filled troughs to form a non-contact gas seal. The rotary hearth furnace is heated by a plurality of burners spaced around the path of rotation of the hearth.

Material to be treated is usually loaded (dropped) onto the rotating hearth surface by a conveyor or chute projecting downwardly through the roof The material is then conveyed through the rotary hearth furnace by the rotation of the hearth to a discharge area where the treated material is removed from the furnace. For a more detailed discussion of the design of a rotary hearth furnace reference is made to U.S. Pat. No. 4,622,905, incorporated herein by reference.

It will be appreciated that in a typical rotary hearth furnace the refractory is heated to operating temperature by burners located in various sections of the furnace. The feed material is heated in the rotary hearth furnace principally by radiation from the surrounding refractory side walls and roof When the material is loaded in multiple layers, the uppermost exposed layer of feed material heats the fastest and attains the highest temperature. Conversely, the bottom layer that is buried under the uppermost exposed layer attains a lower peak temperature and heats more slowly. Although loading of multiple layers of feed material offers the advantage of greater loading and greater production for the same size furnace, successful treatment of the feed material in a rotary hearth furnace requires that all of the feed material have a similar time versus temperature exposure in the furnace. However, as noted above, too great a variation of loading depth of feed material will typically result in unacceptable feed material time versus temperature uniformity in view of the fact that all of the feed material is typically removed from the hearth when the hearth completes one revolution.

It will be appreciated that uniformity of time versus temperature exposure of the feed material in the rotary hearth furnace is best achieved by treating the feed material in a rotary hearth furnace that is capable of uniformly distributing the feed material that is being loaded onto the rotating hearth. The optimum depth of the feed material may vary from a maximum depth which is a function of the critically of the time versus temperature relation of the material to be treated to a minimum uniform depth of about one layer. It will also be appreciated that to increase the efficiency of the treatment of the feed material within the furnace, the feed material must also be uniformly distributed across the entire width of the rotating hearth as the feed material is placed upon the rotating hearth.

In addition to the problem of providing similar time versus temperature treatment of the feed material in a rotary hearth furnace, the rotary hearth surface inherently travels faster at the outer diameter than at the inner diameter because of the greater radius. Feed material is normally fed to the rotary hearth furnace at a constant flow rate. Accordingly, if the feed material is loaded at a uniform rate from the inner diameter to the outer diameter, the depth of the feed material will be greater at the inner diameter of the rotary hearth as compared to the outer diameter. Accordingly, it would be advantageous to provide a uniform feed material depth from the inner diameter to the outer diameter taking into consideration the difference in hearth surface speed.

In view of the foregoing, it is an object of the present invention to provide an improved charging apparatus for a rotary hearth furnace. Yet another object of the present invention is to provide a charging apparatus for a rotary hearth furnace that continuously distributes the feed material across the entire width of the hearth of the furnace. Still another object of the present invention is to provide a charging apparatus for a rotary hearth furnace that distributes the feed material to a uniform depth. It is another object of the present invention to provide a charging apparatus for a rotary hearth furnace that is simple and/or economical to manufacture and/or use.

SUMMARY OF THE INVENTION

Briefly, according to this invention there is provided an apparatus for charging a feed material onto a rotating hearth of a rotary hearth furnace including refractory lined inner and outer walls and having a refractory roof supported thereon. The apparatus includes a table mounted above the rotating hearth and capable of receiving feed material from outside of the rotary hearth furnace. The table extends transversely across the rotating hearth and has a first end including a distribution member, a second end including a plurality of distribution slots, and an intermediate leveling plow. Feed material initially is distributed across the width of the table and then adjusted and leveled to a uniform depth, subsequently, the feed material falls through the distribution slots and as the rotating hearth passes under the table a curtain of feed material is loaded onto the hearth.

BRIEF DESCRIPTION OF THE DRAWINGS

Further features and other objects and advantages of this invention will become clear from the following detailed description made with reference to the drawings in which.

DETAILED DESCRIPTION OF THE PREFERRED EMBODIMENTS

Referring to the figures, there is shown a partial view of a charging apparatus 10 for charging a feed material 12 to a rotary hearth furnace 14 of a type well known in the art. Typically, the rotary hearth furnace 14 includes a refractory roof supported by an annular inner refractory lined wall that is circumscribed by a spaced annular outer refractory lined wall. The inner wall and the outer wall cooperatively define a circular hearth path along which a rotating hearth 16 travels. The rotating hearth 16 generally consists of a metal support plate including a top of a refractory material and having skirts which project into water-filled troughs. The water filled troughs in conjunction with the skirts form a gas tight seal. The rotary hearth furnace 14 is heated by a plurality of burners spaced around the path of rotation of the hearth 16.

The rotary hearth furnace 14 includes a single charge point for charging the feed material 12 to the rotating hearth furnace. The feed material 12 charged to the rotary hearth furnace 14 may comprise most any type of material that is to be reduced or exposed to a high temperature such as metal oxide containing material and the like, e.g. iron oxide. The feed material 12 may be in pellet, briquette or loose granular form.

It should be noted that for purposes of clarity certain details of construction of the rotary hearth furnace 14 are not provided in view of such details being conventional and well within the skill of the art once the invention is disclosed and explained. Reference is made to U.S. Pat. No. 4,622,905 and to the chemical engineering industry literature generally for detailed descriptions of the various apparatus and processing structure and conditions of a rotary hearth furnace 14.

Figure 1:
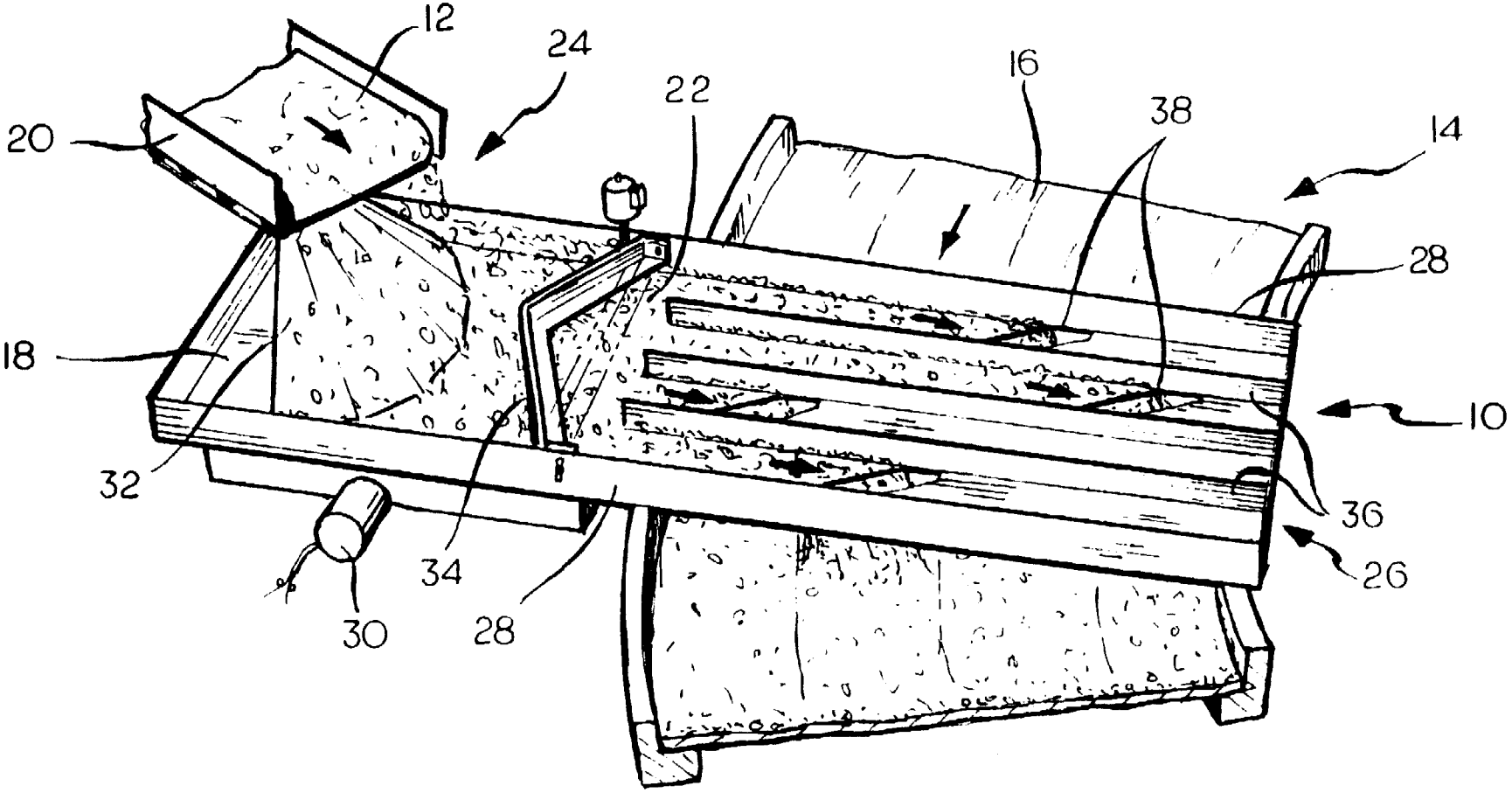
FIG. 1 is a is a partial perspective view of a charging apparatus for a rotary hearth furnace in accordance with the present invention.

Referring to FIG. 1, there is shown an apparatus 10 for charging the feed material 12 onto the rotating hearth 16 of the rotary hearth furnace 14. The apparatus 10 includes a table 18 capable of distributing the feed material 12 across the width of the table and adjusting the depth of the feed material to continuously provide a layer of feed material on the hearth 16 of the furnace of a substantially uniform depth across the entire width of the hearth to provide uniformity of time versus temperature treatment.

Depending upon the type of feed material 12 to be charged to the rotary hearth furnace 14, the feed material may be temporarily stored in a storage bin (not shown) until the feed material is charged to the rotary hearth furnace. As well known in the art, the storage bin may be an open-top or closed-top chamber and the like. It will be appreciated that the feed material 12 may also be fed to the rotary hearth furnace 14 as part of a continuous treatment process as the feed material is produced such that a storage bin is not required for the treatment of the feed material.

In any event, the feed material 12 is transported from the storage bin or transported through the continuous process by means of a conveying member 20. The conveying member 20 may be a chute inclined at an angle greater than the angle of repose of the feed material or the conveying member may be a continuous belt for mechanically feeding the feed material to the table 18.

The table 18 includes a planar surface 22 having a first end 24 and a second end 26 and having longitudinally extending side rails 28 to prevent feed material 12 from dropping over the sides of the table. The table 18 is mounted above the rotating hearth 16 and in communication with the conveying member through an opening within the refractory roof The table 18 extends longitudinally across the width of the hearth 16.

The table 18 may be inclined at an angle greater than the angle of repose of the feed material 12 so that the material relies upon gravity for movement along the planar surface 22 or the table may be level or slightly inclined and include a device 30 for mechanically assisting in the movement of the feed material along the planar surface. For example, the planar surface 22 of the table 18 may be mechanically attached to a vibration device as well known in the art to vibrate the planar surface and cause the feed material to move down the table.

The first end 24 of the table 18 may include a distribution member 32 to uniformly distribute the feed material 12 across the width of the planar surface 22 of the table 18 thereby effectively utilizing the entire cross section of the table surface. As shown in FIGS. 1–4, the distribution member 32 is one-half of an inverted cone. The diameter of the base of the inverted cone approximates the width of the planar surface 22 of the table. The height of the cone may vary to provide an effective distribution of the feed material 12 across the width of the planar surface of the table 18 as the feed material falls along the outer surface of the cone.

Figure 2:
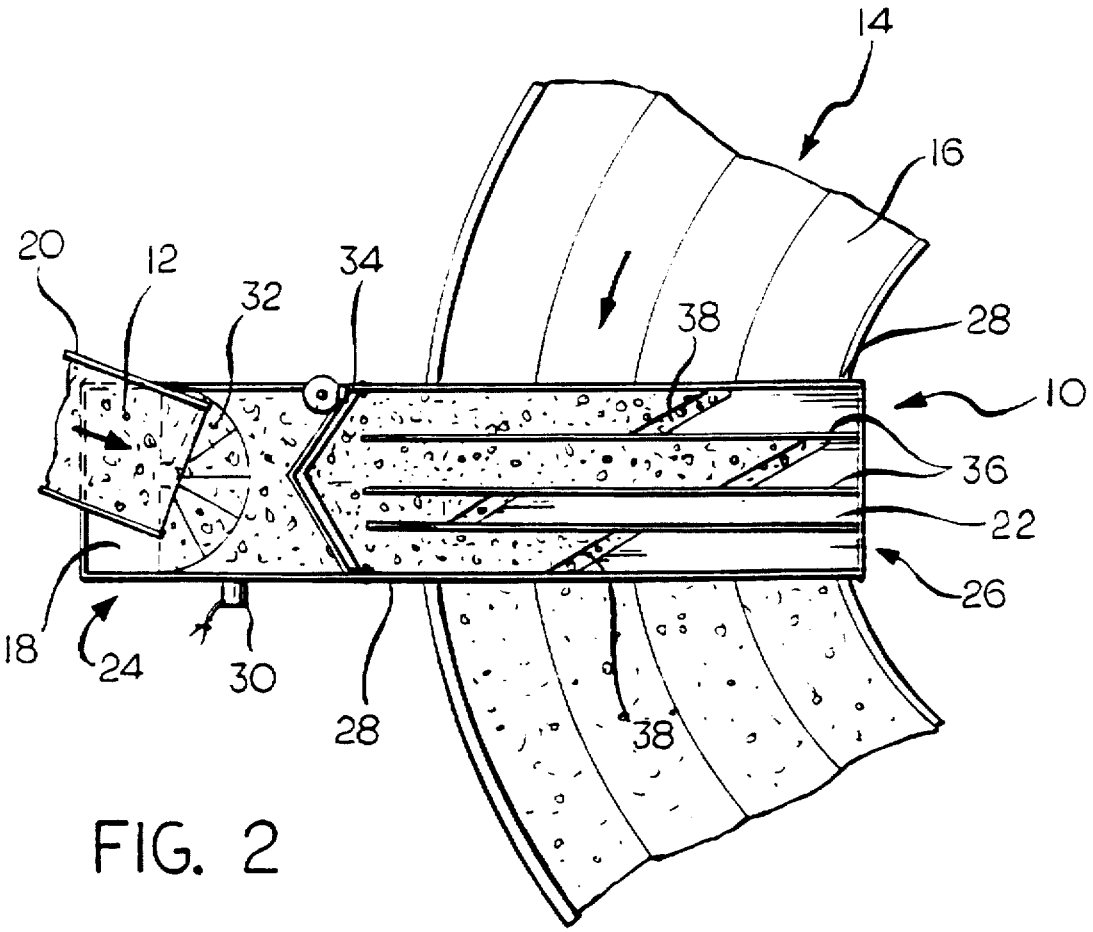
FIG. 2 is a top view of the charging apparatus of FIG. 1.
Figure 3:
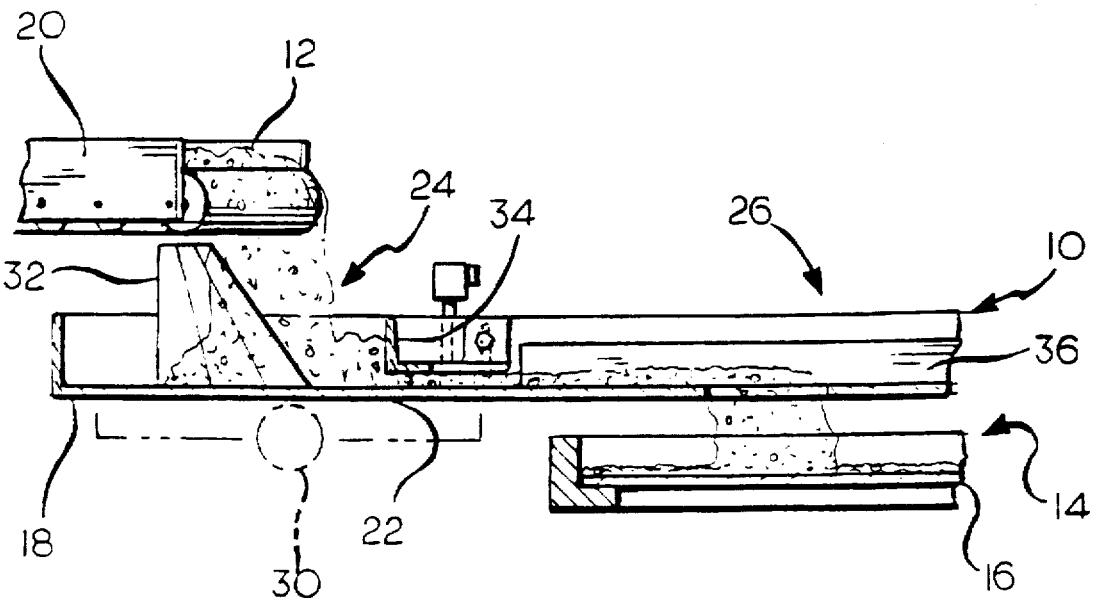
FIG. 3 is a partial cross-sectional view of a charging apparatus for a rotary hearth furnace.

Positioned intermediate the first end 24 and the second end 26 of the table 18 is an optional leveling plow 34. The leveling plow 34 provides a uniform depth to the feed material 12 across the entire width of the planar surface 22 of the table 18. The height of the leveling plow 34 is adjustable with respect to the planar surface 22 of the table to provide varying clearance under the leveling plow. In a preferred embodiment, the leveling plow 34 is v-shaped (FIGS. 1 and 2). However, it will be appreciated that the leveling plow 34 may also be straight (FIG. 3). The height of the leveling plow 34 may be adjusted using most any suitable mechanical means as well known in the art, e.g., slotted side rails and a bolt and nut attached to the leveling plow. In a preferred embodiment, the height of the leveling plow 34 is hydraulically adjustable.

The second end 26 of the table 18 includes a plurality of equally spaced longitudinal dividers 36 of equivalent length and discharge slots 38 of varying size which provide access to the rotating hearth 16 below. In a preferred embodiment, the discharge slots 38 are curved being more radial near the inner hearth diameter and more tangential or larger near the outer diameter of the hearth. As a result, the feed material 12 discharge is greater per unit width of the table 18 at the larger hearth radius when compared to the inner radius resulting in a uniform distribution of feed material across the rotating hearth surface 16 of the rotary hearth furnace.

Figure 4:
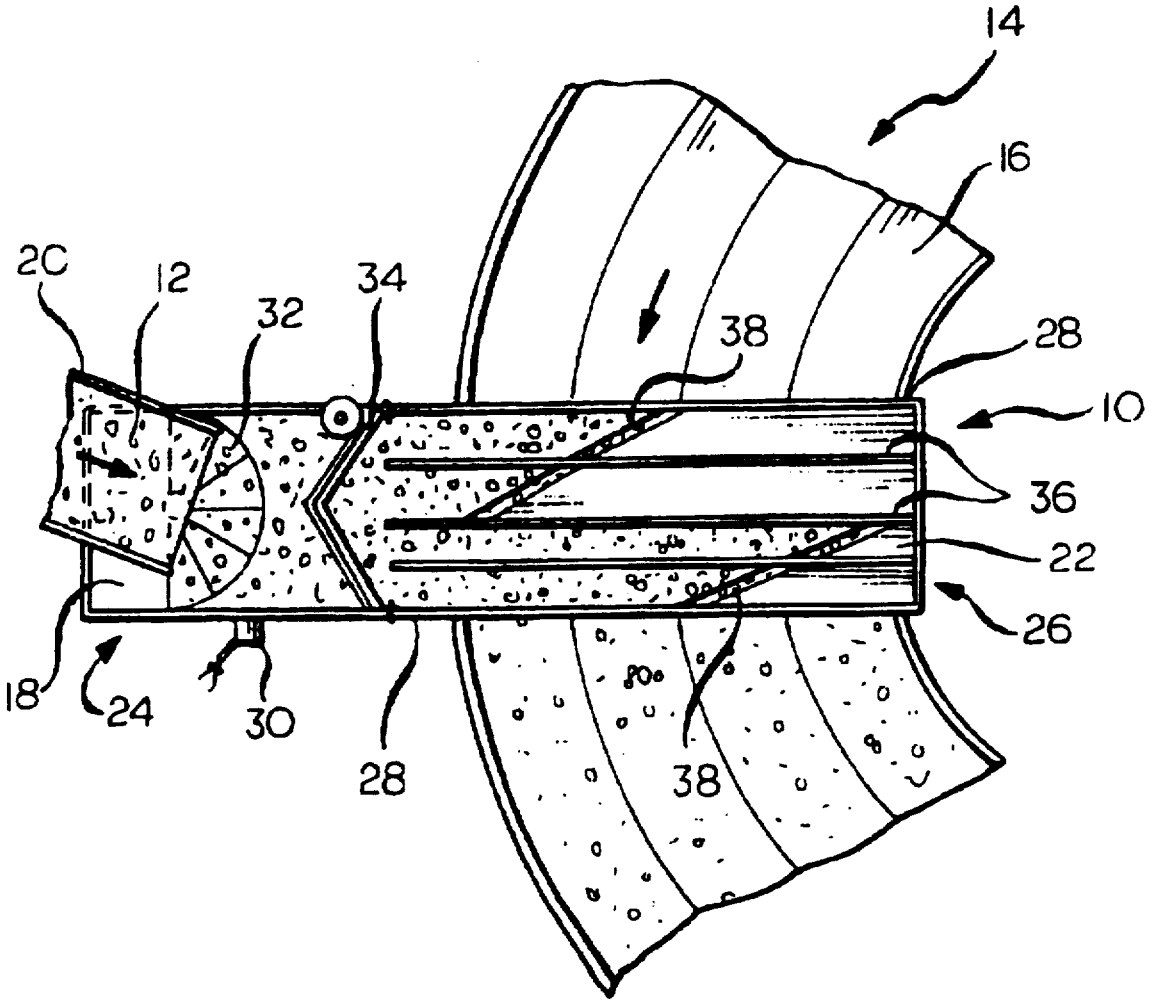
FIG. 4 is a top view of an alternative embodiment of the charging apparatus.

In an alternate embodiment as shown in FIG. 4, the longitudinal dividers 36 may also be of varying spacing and the discharge slots 38 may be of approximately equal size. The longitudinal dividers being of greater spacing containing discharge slots open to the outer radius of the rotating hearth such that greater distribution of feed material 12 is provided at the larger hearth radius when compared to the inner radius.

It will be appreciated that although the placement of the discharge slots 38 provide uniform loading of the feed material on the hearth, the flow of the feed material may also be affected by variations in the lateral movement of the feed material on the table 18. The variations in loading and lateral movement of the feed material on the table are compensated for by dividing the table 18 into longitudinal sections to force the feed material to flow longitudinally on the table and prevent excessive lateral movement. The longitudinal dividers 36 cooperatively define channels that extend the radial width of the rotating hearth 16. A discharge slot 38 is located within each channel between each pair of dividers 36. The discharge slots 38 cooperatively extend across the radial width of the rotating hearth 16 immediately below to provide controlled access to the entire hearth cross-section to meter the placement of the feed material upon the traveling hearth.

In operation, the feed material 12 is conveyed to the table 18 wherein the feed material falls over the outer surface of the distribution member 32 and distributed across the entire width of the planar surface 22 of the table. The feed material 12 is then continuously progressively urged down the planar surface 22 to the leveling plow 34. The feed material 12 is controllably released to a substantially uniform depth across the entire width of the planar surface 22 of the table 18. The feed material 12 of a uniform depth then enters the channels between the dividers 36 wherein the feed material drops under the force of gravity through the discharge slots 38 to the rotating hearth 16 immediately below.

It will be appreciated that because the feed material 12 is of a substantially uniform depth across the entire width of the planar surface 22 of the table 18 prior to falling on the rotating hearth 16, the feed material that does fall on the rotating hearth is also of a substantially uniform depth across the entire width of the rotating hearth such that uniformity of time versus temperature treatment of the feed material within the furnace can be achieved. Furthermore, it will also be appreciated that uniformity of time versus temperature treatment may be achieved regardless of the rate of charge of the feed material to the table.

The documents, patents and patent applications referred to herein are hereby incorporated by reference.

With respect to the above description then, it is to be realized that the optimum dimensional relationships for the parts of the invention, to include variations in size, materials, shape, form, function and manner of operation, assembly and use, are deemed readily apparent once the invention is disclosed and explained, and all equivalent relationships to those illustrated in the drawings and described in the specification are intended to be encompassed by the present invention, e.g., the distribution member 32, leveling plow 34, longitudinal dividers 36 and discharge slots 38 may be employed alone or in combination.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the appended claims.

What is claimed is:

1. An apparatus for charging a feed material onto a rotating hearth of a rotary hearth furnace, the rotary hearth furnace including refractory lined inner and outer walls and having a refractory roof supported thereon, the apparatus comprising:

a table mounted above the rotating hearth and capable of receiving feed material, the table extending transversely across the rotating hearth and having a first end including a distribution member and a second end including a plurality of discharge slots;

wherein feed material free falls over the distribution member and is distributed across the width of the table such that as the rotating hearth passes under the table a curtain of feed material is loaded over the entire width of the rotating hearth.

2. The apparatus of claim 1 further comprising a leveling plow positioned intermediate the first end and the second end to adjust the feed material to a uniform depth.

3. The apparatus of claim 1 wherein the table is inclined at an angle greater than the angle of repose of the feed material.

4. The apparatus of claim 1 wherein the table is inclined at an angle less than the angle of repose and further comprises a device for mechanically assisting in the movement of the feed material along the table.

5. The apparatus of claim 1 wherein the table is level and further comprises a device for mechanically assisting in the movement of the feed material along the table.

6. The apparatus of claim 1 wherein the table includes a planar surface and side rails.

7. The apparatus of claim 6 wherein the device comprises a vibration device.

8. The apparatus of claim 1 wherein the leveling plow is v-shaped.

9. The apparatus of claim 1 wherein the leveling plow is straight.

10. The apparatus of claim 1 wherein the distribution member is an inverted cone.

11. The apparatus of claim 10 wherein the cone includes a base having a diameter that is approximately equal to the width of the planar surface of the table.

12. The apparatus of claim 1 further comprising a plurality of longitudinal dividers at the second end of the table, the longitudinal dividers cooperatively defining channels that extend across the rotating hearth, wherein a discharge slot is located within each channel between each pair of dividers.

13. The apparatus of claim 12 wherein the discharge slots cooperatively extend across the radial width of the rotating hearth to provide controlled access to the entire hearth cross-section to meter the placement of the feed material upon the traveling hearth.

14. The apparatus of claim 12 wherein the longitudinal dividers are equally spaced across the planar surface of the table and the discharge slots are of varying length.

15. The apparatus of claim 12 wherein the longitudinal dividers are of varying spacing.

16. An apparatus for charging a feed material onto a rotating hearth of a rotary hearth furnace, the rotary hearth furnace including refractory lined inner and outer walls and having a refractory roof supported thereon, the apparatus comprising:

a table mounted above the rotating hearth and capable of receiving feed material, the table extending transversely across the rotating hearth and having a first end including a distribution member, a second end including a plurality of longitudinal dividers, the longitudinal dividers cooperatively defining channels that extend across the rotating hearth, wherein a discharge slot is located within each channel between each pair of dividers, and a leveling plow intermediate the first end and the second end;

wherein feed material free falls over the distribution member and is distributed across the width of the table and then adjusted to a uniform depth such that as the rotating hearth passes under the table a curtain of feed material of uniform depth is loaded over the entire width of the rotating hearth.

17. The apparatus of claim 16 wherein the table is inclined at an angle greater than the angle of repose of the feed material.

18. The apparatus of claim 16 wherein the table is inclined at an angle less than the angle of repose and further comprises a device for mechanically assisting in the movement of the feed material along the table.

19. The apparatus of claim 16 wherein the table includes a planar surface and side rails.

20. The apparatus of claim 16 wherein the leveling plow is v-shaped.

21. The apparatus of claim 16 wherein the leveling plow is straight.

22. The apparatus of claim 16 wherein the distribution member is an inverted cone.

23. The apparatus of claim 19 wherein the cone includes a base having a diameter that is approximately equal to the width of the planar surface of the table.

24. The apparatus of claim 16 wherein the discharge slots are curved.

25. The apparatus of claim 24 wherein the discharge slots are radially curved near the inner hearth diameter and tangential near the outer diameter of the hearth.

26. The apparatus of claim 16 wherein the longitudinal dividers are equally spaced across the planar surface of the table and the discharge slots are of varying length.

27. The apparatus of claim 16 wherein the longitudinal dividers are of varying spacing.

* * * * *